US006161787A

United States Patent [19]

Plociennik et al.

[11] Patent Number: 6,161,787

[45] Date of Patent: Dec. 19, 2000

[54] METHOD OF PLACING WIRE WINDINGS ONTO A CONVEYOR BELT AND DEVICE FOR CARRYING OUT THE METHOD

[75] Inventors: Uwe Plociennik, Ratingen; Otmar Palzer, Jülich, both of Germany

[73] Assignee: SMS Schloemann Siemag Aktiengesellschaft, Düsseldorf, Germany

[21] Appl. No.: 09/168,038

[22] Filed: Oct. 7, 1998

[30] Foreign Application Priority Data

Oct. 22, 1997 [DE] Germany ..... 197 46 495

[51] Int. Cl.[7] ..... B21C 47/02; B65H 54/00

[52] U.S. Cl. ..... 242/363; 242/361

[58] Field of Search ..... 242/360, 361, 242/361.4, 363

[56] References Cited

U.S. PATENT DOCUMENTS

| | | | |
|---|---|---|---|
| 2,526,312 | 10/1950 | Winterhalter . | |
| 3,832,788 | 9/1974 | Kato et al. | 242/361 |
| 4,914,935 | 4/1990 | Fryer | 242/363 |
| 5,079,937 | 1/1992 | Scholer | 72/13.8 |

FOREIGN PATENT DOCUMENTS

| | | | |
|---|---|---|---|
| 0432531 | 6/1991 | European Pat. Off. . | |
| 4117906 | 12/1992 | Germany | 242/363 |
| 4118958 | 12/1992 | Germany | 242/363 |
| 40-5337533 | 12/1993 | Japan | 242/363 |
| 40-6047436 | 2/1994 | Japan | 242/363 |

*Primary Examiner*—John M. Jillions
*Attorney, Agent, or Firm*—Friedrich Kueffner

[57] ABSTRACT

A method and a device for placing wire windings onto a conveyor belt, particularly onto a Stelmor conveyor belt, wherein the wire windings are placed on the conveyor belt in an actual position relative to the belt middle. The wire windings are placed on the conveyor belt in a position-controlled manner relative to the belt middle. The device for carrying out the method includes a sensor for determining the actual position of the wire windings on the conveyor belt and a control unit, - wherein an actual position and a nominal position are supplied to the control unit and the control unit determines from the difference between the actual position and the nominal position a control signal for the control element and supplies this signal to the control element.

12 Claims, 1 Drawing Sheet

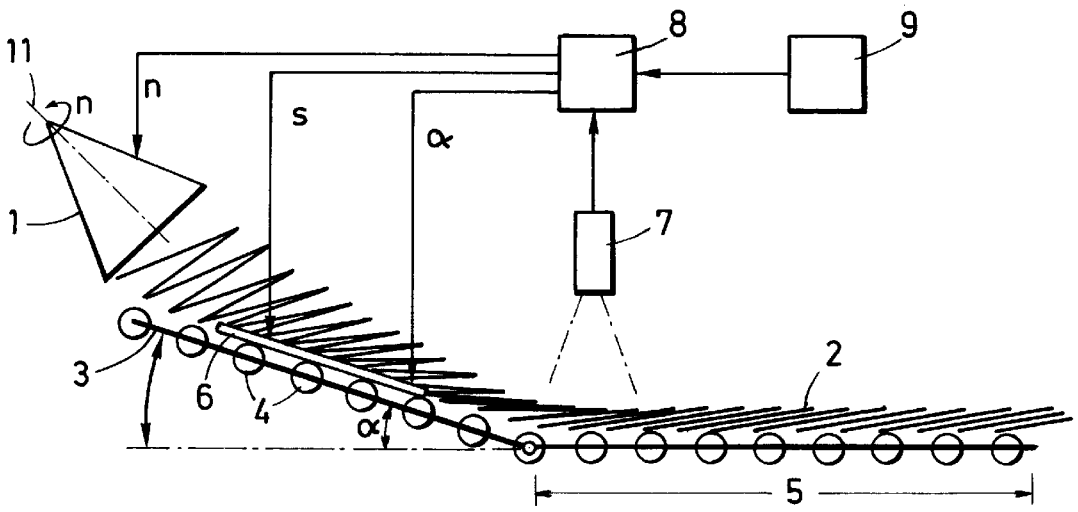
FIG.1
FIG.2
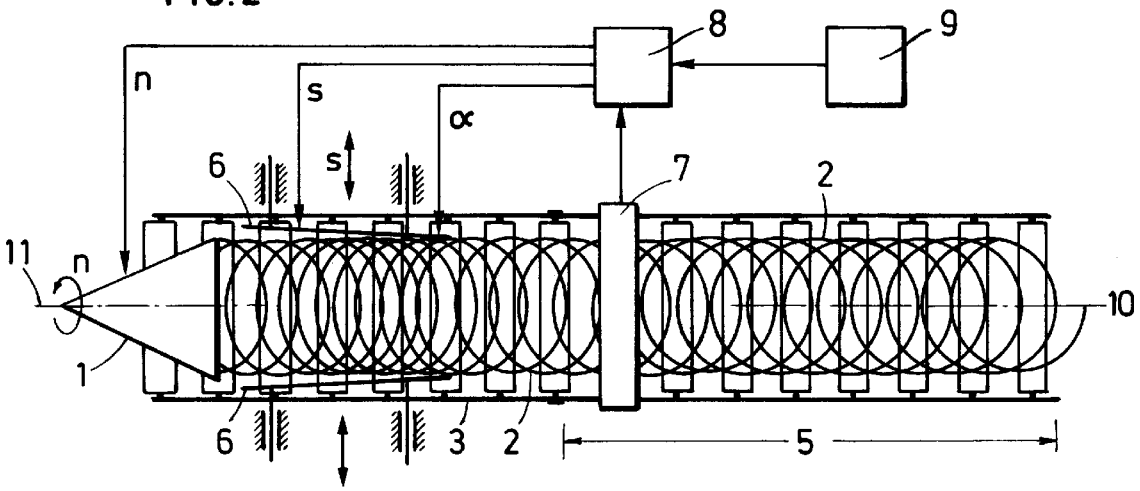
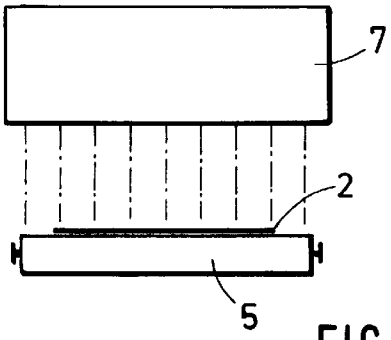
FIG.3
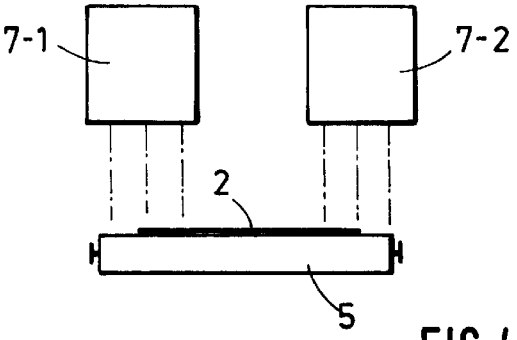
FIG.4

METHOD OF PLACING WIRE WINDINGS ONTO A CONVEYOR BELT AND DEVICE FOR CARRYING OUT THE METHOD

BACKGROUND OF THE INVENTION

1. Field of the Invention

The present invention relates to a method of placing wire windings onto a conveyor belt having a belt middle, particularly onto a Stelmor conveyor belt, wherein the wire windings are placed on the conveyor belt in an actual position relative to the belt middle.

The present invention also relates to a device for placing wire windings onto a conveyor belt having a belt middle, particularly a Stelmor conveyor belt, with a laying head for placing the wire windings onto the conveyor belt and a control element for influencing the actual position of the wire windings on the conveyor belt.

2. Description of the Related Art

When rolling wire from billets, the prior art provides that the rolled wire is placed in wire windings on a Stelmor conveyor belt and is cooled on this conveyor belt. In order to keep strength differences within the wire windings as low as possible, the wire windings must be cooled uniformly. The prior art ensures this only to an insufficient extent.

SUMMARY OF THE INVENTION

Therefore, it is the primary object of the present invention to provide a method of placing wire windings and a device for carrying out the method in which a uniform cooling of the wire windings on the conveyor belt can be achieved.

In accordance with the present invention, the wire windings are placed on the conveyor belt in a position-controlled manner relative to the belt middle.

The device according to the present invention for carrying out the above-described method includes a sensor for determining the actual position of the wire windings on the conveyor belt and a control unit, wherein an actual position and a nominal position are supplied to the control unit and the control unit determines from the difference between the actual position and the nominal position a control signal for the control element and supplies this signal to the control element.

The measures described above make it possible to achieve a defined position of the wire windings on the conveyor belt. In view of this defined position, cooling flows can be coordinated and directed in such a way that a uniform cooling of the wire windings is achieved. Conversely, when the cooling flow is known, the position of the wire windings can be controlled in such a way that a uniform cooling effect is achieved.

The sensor device for determining the actual position of the wire windings may be, for example, an ultrasound sensor or an infrared sensor. However, particularly suitable has been found to be an optical sensor device which may be constructed, for example, as a CCD camera.

In accordance with the prior art, wire windings are placed on the conveyor belt by means of a laying head which rotates with a certain rate of rotation about an axis of rotation, wherein the rate of rotation is adjustable. The wire windings are placed by the laying head initially onto a ramp which extends at an angle of inclination relative to the horizontal. The wire windings are further conveyed from the ramp to the conveyor belt. The angle of inclination of the ramp is adjustable. Guide bars whose lateral position is adjustable are arranged at the ramp and/or the conveyor belt. The guide bars laterally guide the wire windings which have been placed on the ramp or the conveyor belt. For controlling the actual position of the wire windings, it is possible selectively to change the rate of rotation of the laying head, the angle of inclination of the ramp and/or the position of the guide bars.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIG. 1 is a side view showing a Stelmor conveyor belt with a device for placing wire windings onto the conveyor belt;

FIG. 2 is a top view of a Stelmor conveyor belt with a device for placing wire windings onto the conveyor belt; and FIGS. 3 and 4 schematically show optical sensor devices for determining the actual position of the wire windings.

DESCRIPTION OF THE PREFERRED EMBODIMENTS

A laying head 1 illustrated in FIGS. 1 and 2 is supplied with wire from a billet rolling train, not shown. The wire has a diameter, for example, of between 5 and 19 mm. The wire is shaped by the laying head 1 into wire windings 2 and is placed onto a ramp 3. The wire is conveyed from the ramp 3 over conveyor rollers 4 onto a Stelmor conveyor belt 5. The wire windings 2 are laterally guided by means of guide bars 6 arranged on the sides of the ramp.

An optical sensor device 7 is arranged at the beginning of the Stelmor conveyor belt 5. The optical sensor device 7 is constructed as a CCD camera. Accordingly, the sensor device 7 has a plurality of light-sensitive cells arranged one next to the other. The sensor signal of the sensor device 7 is supplied to a control unit 8. A simulation computer 9 of a higher order additionally supplies a nominal position of the wire windings 2 to the control unit 8.

The control unit 8 determines an actual position of the wire windings 2 from the sensor signal of the optical sensor device 7. The accuracy of the actual position is determined by the dissolution of the optical sensor device 7 in connection with the width of the Stelmor conveyor belt 5. For example, if the number of image points of the optical sensor device 7 is 2,200 and the conveyor belt width is 1.5 m, the dissolution is less than 1 millimeter.

The control unit 8 uses the difference between the predetermined nominal position and the determined and computed actual position of the wire windings 2 for computing a control signal for a control element for adjusting the actual position to the nominal position. The wire windings 2 are usually to be placed centrally with respect to the belt middle 10 of the Stelmor conveyor belt 5 with a certain winding diameter.

For placing the wire windings 2 by means of the laying head 1, the laying head 1 rotates with an adjustable rate of rotation n about an axis of rotation 11. The position of the wire windings 2 on the Stelmor conveyor belt 5 may be influenced, for example, by changing the rate or rotation n of the laying head 1. This is particularly advantageous when the diameter of the wire is less than 12 mm.

A change of the rate of rotation n of the laying head 1 influences the winding diameter in addition to the actual position of the wire windings 2. Accordingly, a control using the rate of rotation n of the laying head 1 is only possible within narrow limits.

The ramp 3 includes with the horizontal direction an angle of inclination α. Alternatively and/or additionally to controlling the rate of rotation n of the laying head 1, the actual position of the wire windings 2 can also be influenced by influencing the angle of inclination α of the ramp 3 and/or the lateral position s of guide bars 6. This is advantageous especially in the case of a diameter of the wire greater than 10 mm. Especially in the case of smaller diameters of the wire, there is the danger that the wire windings 2 are being deformed when they are laterally shifted by the guide bars 6.

As shown in FIGS. 1 and 2 and also in FIG. 3, the optical sensor device 7 is constructed as a CCD camera 7 which extends over the entire width of the Stelmor conveyor belt 5. Such a sensor device 7 is particularly useful in those cases in which it is not known from the outset onto what portion of the Stelmor conveyor belt 5 the wire windings 2 are to be placed.

However, as a rule, the wire windings 2 are placed over a major portion of the belt width of the Stelmor conveyor belt 5. In the case of a belt width of, for example, 1.5 m, the winding diameters typically are in the range of between 1.3 m and 1.45 m. Accordingly, it may be more advantageous with respect to cost to use two CCD cameras 7-1 and 7-2 instead of one CCD camera 7 which extends over the entire width of the Stelmor conveyor belt 5. The two CCD cameras 7-1 and 7-2 cover the left and right edge areas, respectively, of the Stelmor conveyor belt 5. This situation is schematically illustrated in FIG. 4. For example, the two CCD cameras 7-1 and 7-2 cover the outermost 30 cm of the Stelmor conveyor belt 5 which has a total width of, for example, 1.5 m.

The CCD camera 7 shown in FIG. 3 or the CCD cameras 7-1, 7-2 shown in FIG. 4 supply up to 100 signals per second to the control unit 8. Consequently, the number of signals from when a wire winding 2 is detected up to when the next wire winding 2 is detected results directly in the time between the detection of two wire windings 2. Together with the speed at which the wire windings 2 are conveyed on the Stelmor conveyor belt 5, this time between the two wire windings 2 results in the geometric distance between the wire windings 2 on the Stelmor conveyor belt 5.

In the illustrated embodiment, single-line CCD cameras 7, 7-1, 7-2 are used. Of course, it is alternatively also possible to use a multiple-line CCD camera 7 or multiple CCD cameras 7-1, 7-2. The term "multiple line" means that the respective camera 7, 7-1, 7-2 has several parallel lines which each extend over the width or the edge portion of the Stelmor conveyor belt 5. Of course, when multiple-line cameras 7, 7-1, 7-2 are used, the distance between the wire windings 2 can be determined directly by evaluating a single two-dimensional sensor signal.

The method for placing wire windings in accordance with the present invention and the device for carrying out the method have above been described in connection with a Stelmor conveyor belt 5. However, the present invention can also be used in other conveyor belts in which it is necessary or desired that the wire windings 2 are accurately positioned on the conveyor belt.

While specific embodiments of the invention have been shown and described in detail to illustrate the inventive principles, it will be understood that the invention may be embodied otherwise without departing from such principles.

We claim:

1. A method of placing wire windings on a conveyor belt having a belt middle, the method comprising placing the wire windings on the conveyor belt in an actual position relative to the belt middle, further comprising placing the wire windings on the conveyor belt in a position-controlled manner relative to the belt middle, wherein the wire windings are placed on the conveyor belt by a laying head which rotates about an axis of rotation with a changeable rate of rotation, further comprising changing the rate of rotation of the laying head for controlling the actual position of the wire windings.

2. The method according to claim 1, comprising placing the wire windings onto a Stelmor conveyor belt.

3. The method according to claim 1, comprising determining the actual position of the wire windings by an optical sensor device.

4. The method according to claim 1, comprising determining the actual position of the wire windings by a CCD camera.

5. A method of placing wire windings on a conveyor belt having a belt middle, the method comprising placing the wire windings on the conveyor belt in an actual position relative to the belt middle, further comprising placing the wire windings on the conveyor belt in a position-controlled manner relative to the bell: middle, comprising placing the wire windings initially onto a ramp having an angle of inclination adjustable relative to the horizontal, further conveying the wire windings from the ramp to the conveyor belt, and changing the angle of inclination of the ramp for controlling the actual position of the wire windings.

6. A method of placing wire windings on a conveyor belt having a belt middle, the method comprising placing the wire windings on the conveyor belt in an actual position relative to the belt middle, further comprising placing the wire windings on the conveyor belt in a position-controlled manner relative to the belt middle, comprising laterally guiding the wire windings by laterally adjustable guide bars, and changing the position of the guide bars for controlling the actual position of the wire windings.

7. A device for a position-controlled placement of wire windings in an actuator position onto a conveyor belt having a belt middle, the device comprising a laying head for placing the wire windings onto the conveyor belt, a sensor device for determining the actual position of the wire windings on the conveyor belt, a control element for influencing the actual position of the wire windings on the conveyor belt, and a control unit for receiving the actual position and a nominal position of the wire windings and for determining an adjusting signal for the control element from a difference between the actual position and the nominal position and for supplying the signal to the control element, wherein the control element is a laying head with an adjustable rate of rotation, and wherein the adjusting signal is the rate or, rotation of the laying head.

8. The device according to claim 7, wherein the sensor device is comprised of an optical sensor device.

9. The device according to claim 7, wherein the optical sensor device is a CCD camera.

10. The device according to claim 7, wherein the conveyor belt is a Stelmor conveyor belt.

11. A device for a position-controlled placement of wire windings in an actual position onto a conveyor belt having a belt middle, the device comprising a laying head for placing the wire windings onto the conveyor belt, a sensor device for determining the actual position of the wire windings on the conveyor belt, a control element for influencing the actual position of the wire windings on the conveyor belt, and a control unit for receiving the actual position and a nominal position of the wire windings and for determining an adjusting signal for the control element from a difference between the actual position and the nominal position and for supplying the signal to the control element, wherein the control element is comprised of a ramp upstream of the conveyor belt, the ramp having an adjustable angle of inclination, wherein the adjusting signal is the angle of inclination of the ramp.

12. A device for a position-controlled placement of wire windings in an actual position onto a conveyor belt having a belt middle, the device comprising a laying head for placing the wire windings onto the conveyor belt, a sensor device for determining the actual position of the wire windings on the conveyor belt, a control element for influencing the actual position of the wire windings on the conveyor belt, and a control unit for receiving the actual position and a nominal position of the wire windings and for determining an adjusting signal for the control element from a difference between the actual position and the nominal position and for supplying the signal to the control element, wherein the control element is comprised of guide bars arranged laterally adjustable on the conveyor belt, and wherein the adjusting signal is the lateral position of the guide bars.

* * * * *